US011970668B2

(12) United States Patent
Abdallah et al.

(10) Patent No.: US 11,970,668 B2
(45) Date of Patent: Apr. 30, 2024

(54) HEAT ACTIVATED DETERGENTS, FUELS INCLUDING SUCH DETERGENTS AND METHODS OF USE

(71) Applicant: ExxonMobil Technology and Engineering Company, Annandale, NJ (US)

(72) Inventors: David J. Abdallah, Moorestown, NJ (US); Krystal B. Wrigley, Asbury, NJ (US)

(73) Assignee: EXXONMOBIL TECHNOLOGY AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 17/804,177

(22) Filed: May 26, 2022

(65) Prior Publication Data

US 2023/0383204 A1 Nov. 30, 2023

(51) Int. Cl.

| | |
|---|---|
| ***C10L 10/04*** | (2006.01) |
| ***C10L 1/16*** | (2006.01) |
| ***C10L 10/18*** | (2006.01) |

(52) U.S. Cl.

CPC ..... *C10L 1/1666* (2013.01); *C10L 10/04* (2013.01); *C10L 10/18* (2013.01); *C10L 2200/0469* (2013.01)

(58) Field of Classification Search

CPC ..... C10L 1/1666; C10L 10/04; C10L 10/18; C10L 2200/0469

See application file for complete search history.

(56) References Cited

U.S. PATENT DOCUMENTS

| | | | | |
|---|---|---|---|---|
| 160,142 | A | 2/1875 | Behel | |
| 264,119 | A | 9/1882 | Allen | |
| 3,172,892 | A | 3/1965 | Suer et al. | |
| 3,219,666 | A | 11/1965 | Norman et al. | |
| 3,634,515 | A | 1/1972 | Piasek et al. | |
| 4,234,435 | A | 11/1980 | Meinhardt et al. | |
| 6,140,541 | A | 10/2000 | Melder et al. | |
| 8,961,623 | B2 | 2/2015 | Stevenson et al. | |
| 9,340,742 | B1 | 5/2016 | Fang et al. | |
| 9,574,149 | B2 | 2/2017 | Fang et al. | |
| 10,173,963 | B2 | 1/2019 | Hansch et al. | |
| 10,308,888 | B1 | 6/2019 | Schwab | |
| 10,479,950 | B2 | 11/2019 | Stevenson et al. | |
| 2004/0009363 | A1* | 1/2004 | Shouldice | B41M 5/52 428/500 |
| 2007/0245621 | A1* | 10/2007 | Malfer | C10L 1/221 44/415 |
| 2020/0024536 | A1 | 1/2020 | Shanahan et al. | |

OTHER PUBLICATIONS

"Detail Specification Propellant, Rocket Grade Kerosene", MIL-DTL-25576E, pp. 1-11 (Apr. 14, 2006).

(Continued)

*Primary Examiner* — Ellen M McAvoy
*Assistant Examiner* — Chantel Graham
(74) *Attorney, Agent, or Firm* — Shook, Hardy & Bacon L.L.P.

(57) ABSTRACT

Provided herein are heat activated fuel detergents, liquid fuel compositions including such heat activated fuel detergents and methods for improving intake valve and injector cleanliness of an engine for a vehicle utilizing such liquid fuel composition.

26 Claims, 2 Drawing Sheets

(56) References Cited

OTHER PUBLICATIONS

Lizza, J., R., et al., "2,2,6,6-Tetramethylpiperidin-1-yloxycarbonyl: A Protecting Group for Primary, Secondary, and Heterocyclic Amines", Organic Letters, vol. 20, pp. 6760-6764 (2018).
Greene, T., W., and Wuts, P., G., M., "Protective Groups in Organic Synthesis", Third Edition, Wiley-Interscience, pp. 1-52 (1999).

* cited by examiner

HEAT ACTIVATED DETERGENTS, FUELS INCLUDING SUCH DETERGENTS AND METHODS OF USE

FIELD

This disclosure relates to heat activated detergent additives, fuel compositions including such detergent additives and methods for improving engine performance with respect to fuel economy and power output by using fuel compositions including such heat activated detergent additives.

BACKGROUND

Fuel detergents are typically fuel soluble surfactants. Typical fuel detergents include a large nonpolar tail that facilitates their fuel solubility, and a relatively small polar head group that is attracted to polar surfaces, fuel deposits, dirt and water. The polar head group typically consist of a nitrogen-containing functional group such as an amine, polyamine, imide, imine, or ammonium salt in order to favorably interact with organic acids which are found in fuel deposits as well as with hydroxyl groups which are found on polar surfaces and water. Fuel detergents inhibit deposit formation by either forming a protective film which impedes deposit precursors from accumulating on polar surfaces or by solubilizing deposit precursors so such precursors remain dispersed in the fuel.

Fuel detergents are designed to prevent and remove deposits from intake valves and fuel injectors that interfere with the functioning of the engine by leading to incomplete combustion of the fuel resulting in higher engine out emission, reduced power and poorer fuel economy.

Conventional fuel detergents are "always active" and therefore may be consumed before having a chance to affect the target area such as the intake valves or injectors that they are primarily intended to clean. Because only a small portion of the fuel system of a vehicle actually requires detergency to improve engine performance, it is wasteful to use excessive concentrations of a conventional fuel additive detergent to compensate for misuse in non-targeted areas of the fuel system. In addition, the additized fuel composition encounters deposits, dirt and water in the transport, storage and distribution of the fuel before entering into the vehicle's fuel tank. A conventional fuel detergents "always active" character necessitates higher treat levels in the fuel composition to compensate for the consumption of the detergent upstream of the vehicles fuel tank. Furthermore, any upstream cleaning action of the detergents in the fuel composition leads to carryover of the dispersed upstream byproducts into the fuel which contaminates the vehicle's fuel system.

Conventional fuel detergents can cause water emulsification and foaming when blended with fuel. These undesirable behaviors often require the use of additional polymeric additives such as demulsifiers and defoamants to counteract the water and air entrainment harms caused by detergents. These additives adds additional cost and complexity to the additive package. There are some application, such as aviation fuel, that have strict water separation requirements. Detergent additives that emulsify can be a safety concern as the entrained water can freeze fuel lines at the very cold temperatures where aircraft operate.

The literature has linked polymeric performance additives in gasoline with a tendency to increase the formation of combustion chambers deposits (CCD) over those found for the non-additized gasoline. Thus, the CCD harm will increase when increase levels of polymeric additives such as detergents, demulsifiers and defoamants are used in the fuel. The detergent treat level is established by balancing the benefits of cleaning specific areas of the fuel system such as intake valves and injectors while minimizing the CCD detriment. The use of additional performance additives to counter possible consumption in unimportant areas creates a larger CCD debit.

Fuel detergents are known to build up in the engine oil as some of these additives are swept to the sump from the combustion chamber walls. The amount of fuel additive that transfers to the oil is proportional to amount and molecular size of the additive used in the fuel. With the current trend of motor oil products moving to longer periods between oil changes it is becoming increasingly important to minimize the level of fuel additives that end up in the oil. To maintain the delicate balance of lube additives over the extended oil drain intervals it would be beneficial for less fuel additives to be swept to the sump which can only be achieved by using lower treat levels. Using less additives requires the additives to be more effective to achieve the same cleanliness.

There are numerous detergent-type gasoline additives currently available which, to varying degrees, perform fuel system cleaning, mainly intake valves and fuel injectors. The head group of these fuel detergent are typically a nitrogen containing functional group; amine, polyamine, imide, imine, or ammonium salt. Amines constitute one of the more typical head groups in fuel detergents. Patent publications have disclosed detergent additives that include, but are not limited to, Mannich reaction products formed by condensing a long chain aliphatic hydrocarbon-substituted phenol or cresol with an aldehyde, and an amine (U.S. Pat. No. 3,634,515), long chain aliphatic hydrocarbons having an amine or a polyamine attached thereto (U.S. Pat. No. 6,140,541A), polyalkenyl succinimides (U.S. Pat. Nos. 3,219,666, 4,234,435, 3,172,892), and quaternary ammonium salt detergents (U.S. Pat. Nos. 10,479,950B2, 0,264,119A1, 8,961,623B2, US 20200024536A1, U.S. Pat. Nos. 10,308,888B1, 9,574,149B2, 9,340,742B1, 10,173,963B2, 0,160,142A1). Each of the above referenced patent publications are herein incorporated by reference herein in their entirety.

Hence, there is a need for fuel detergents that are only active where they are primarily intended to function and clean. Generally, these intended areas are the intake valves and fuel injectors which are relatively hotter than other parts of the fuel system. There is also a need to use more efficacious additives so the amount of fuel additive can be minimized to lower emulsification, foaming, CCD and oil dilution issues.

SUMMARY

The instant disclosure relates to heat activated fuel detergents, liquid fuel compositions including such heat activated fuel detergents and methods for improving intake valve and injector cleanliness of an engine for a vehicle utilizing such liquid fuel composition. The heat activated fuel detergent disclosed herein include a polyisobutylene and/or hydrocarbylpoly(oxyalkylene) polymeric backbones with specific types of nonpolar masking groups capable of improving intake valve and injector cleanliness of an engine when utilized in the vehicles fuel composition.

In one form, the heat activated fuel detergent with a polyisobutylene polymeric backbone is of the following formula:

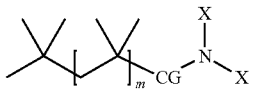

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 50.

Also disclosed herein is a liquid fuel composition comprising: a liquid fuel and an effective amount of a heat activated detergent additive of the following formula:

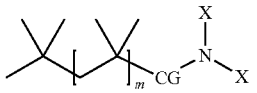

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 30.

Still also disclosed herein is a method for improving intake valve and injector cleanliness of an engine for a vehicle utilizing a liquid fuel composition comprising the following: providing to the vehicle a liquid fuel composition comprising a liquid fuel including an effective amount of a heat activated detergent additive of the following formula:

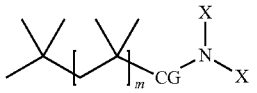

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 30, injecting the liquid fuel composition into the engine and combusting the liquid fuel composition, and measuring the amount of deposits on the engine valves and the engine injectors, wherein the amount of deposit build-up on the engine intake valves (intake valve deposits) are decreased by about 10% to about 100% compared to a comparable liquid fuel not including the heat activated detergent additive.

Yet still also disclosed herein is a heat activated fuel detergent with a hydrocarbylpoly(oxyalkylene) polymeric backbone of the following formula:

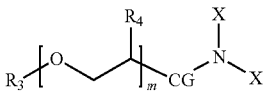

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 50, wherein $R_3$ is a hydrocarbyl group including from 1 to 30 carbon atoms, and wherein $R_4$ is a hydrocarbyl group including from 1 to 6 carbon atoms.

Yet still further also disclosed herein is a liquid fuel composition comprising: a liquid fuel and an effective amount of a heat activated detergent additive of the following formula:

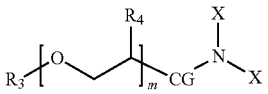

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 50, wherein $R_3$ is a hydrocarbyl group including from 1 to 30 carbon atoms, and wherein $R_4$ is a hydrocarbyl group including from 1 to 6 carbon atoms.

Yet still further also disclosed herein is a method for improving intake valve and injector cleanliness of an engine for a vehicle utilizing a liquid fuel composition comprising the following: providing to the vehicle a liquid fuel composition comprising a liquid fuel including an effective amount of a heat activated detergent additive of the following formula:

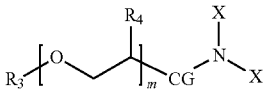

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 30, wherein R3 is a hydrocarbyl group including from 1 to 30 carbon atoms, and wherein R4 is a hydrocarbyl group including from 1 to 6 carbon atoms, injecting the liquid fuel composition into the engine and combusting the liquid fuel composition, and measuring the amount of deposits on the engine valves and the engine injectors, wherein the amount of deposit build-up on the engine intake valves (intake valve deposits) are decreased by about 10% to about 100% compared to a comparable liquid fuel not including the heat activated detergent additive.

DETAILED DESCRIPTION

Definitions

Figure 1:
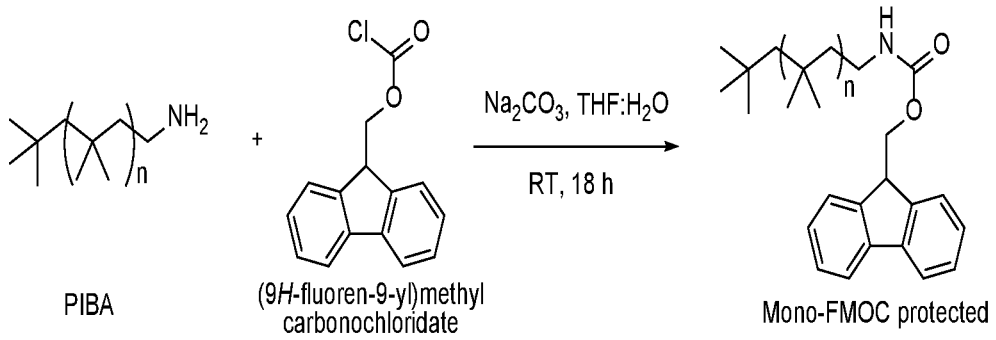
FIG. 1 depicts the synthesis of FMOC protected polyisobutylene amine ("PIBA") by reaction of BASF KEROCOM PIBA 03, which is an amine detergent in solvent, with (9H-fluoren-9-yl)methyl carbonochloridate using standard FMOC-amine protection chemistry.

"About" or "approximately." All numerical values within the detailed description and the claims herein are modified by "about" or "approximately" the indicated value, and take into account experimental error and variations that would be expected by a person having ordinary skill in the art.

"Major amount" as it relates to components included within the fuel compositions of the specification and the claims means greater than or equal to 50 wt. %, or greater than or equal to 60 wt. %, or greater than or equal to 70 wt. %, or greater than or equal to 80 wt. %, or greater than or equal to 90 wt. % based on the total weight of the fuel.

"Minor amount" as it relates to components included within the fuel compositions of the specification and the claims means less than 50 wt. %, or less than or equal to 40 wt. %, or less than or equal to 30 wt. %, or greater than or equal to 20 wt. %, or less than or equal to 10 wt. %, or less than or equal to 5 wt. %, or less than or equal to 2 wt. %, or less than or equal to 1 wt. %, based on the total weight of the fuel.

"Essentially free" as it relates to components included within the fuel compositions of the specification and the claims means that the particular component is at 0 weight % within the fuel composition, or alternatively is at impurity type levels within the fuel (less than 100 ppm, or less than 20 ppm, or less than 10 ppm, or less than 1 ppm).

"Fuel additives" as used in the specification and the claims means fuel additives (other than heat activated detergents) that are not specifically recited in the particular section of the specification or the claims. "Fuel additives" include antioxidants, friction modifiers and lubricity improvers, antiwear additives, corrosion inhibitors, dehazers/demulsifiers, dyes, markers, odorants, octane improvers, combustion modifiers, antimicrobial agents, and combinations thereof. Fuel additives as used in the specification and the claims do not include heat activated detergent additives. Non-limiting examples of suitable friction modifiers include esters (for example glycerol monooleate) and fatty acids (for example oleic acid and stearic acid). Non-limiting examples of suitable corrosion inhibitors include ammonium salts of organic carboxylic acids, amines and heterocyclic aromatics, for example alkylamines, imidazolines and tolyltriazoles. Non-limiting examples of suitable non-metallic octane improvers include N-methyl aniline and other aniline derivatives. Non-limiting examples of suitable anti-oxidants include phenolic anti-oxidants (for example 2,4-di-tert-butylphenol and 3.5-di-tert-butyl-4-hydroxyphenylpropionic acid) and aminic anti-oxidants (for example para-phenylenediamine, dicyclohexylamine and derivatives thereof). Non-limiting examples of suitable demulsifiers include phenolic resins, esters, polyamines, sulphonates or alcohols that have been reacted with ethylene or propylene oxide.

Compositions and Methods of the Instant Disclosure

Provided are heat activated detergents (HADs), liquid fuels including such detergents and methods of using such fuels with heat activated detergents to improve vehicle engine performance. In particular, the fuels incorporating such heat activated detergents have reduced intake valve deposits (IVD) and improved injector cleanliness.

Additionally, provided are heat activated detergents for use in hydrocarbon fuels which reduce engine deposits in spark and compression ignition internal combustion engines. The heat activated detergents described here overcome the many debits created by the current types of "always active" detergents. Deposits generally appear in hot areas of the fuel system marked by elevated temperatures that accelerate oxidation reactions. The heat activated detergents are designed to be activated into detergents in these hot areas which make up a small volume of the total fuel system. This is achieved by masking the nitrogen head group with a hydrophobic group that diminishes the surfactant character so it's less prone to stick to unimportant surfaces, scavenge upstream deposits and dirt and emulsify water when in its masked form. The HADs are reaction products of a conventional fuel detergent with specific types of nonpolar masking groups.

The heat activated detergents disclosed herein overcome the many debits created by the prior art types of "always active" detergents. Deposits generally appear in hot areas of the engine marked by accelerated oxidation reactions of the fuel. Ideally a detergent should be active only in these target areas of the fuel system. This would allow substantially less detergent additive to be used in the fuel considering that these target areas represent a very small volume of the overall system. It has been discovered that detergents with a hydrophobic protective groups disclosed herein can be unmasked by temperature to the active form of the detergent to provide targeted cleaning action in the hot areas of the fuel system where deposits are more prone and have a pronounced impact on engine performance.

This is achieved by masking the hydrophilic nitrogen head group with a hydrophobic group that diminishes the surfactant character so that it is less prone to clean and attach to unimportant surfaces, upstream deposits, dirt and water. The HAD's disclosed herein are the reaction products of a fuel detergent with a nonpolar masking group. HAD's are more effective at cleaning hot engine components because the polar head group character is activated on important surfaces of the vehicles engine. In addition, the heat activated detergents disclosed herein lessen the need for demulsifiers/deformers in the fuel compositions because the surfactant character is reduced.

A heat activated detergent (HAD) for the purpose of this disclosure is defined as an aminic type detergent that has been reacted with an amine protective group to mask the polar characteristics of the head group until it is cleaved at elevated temperatures. Protecting the amine head group in a fuel detergent incorporated into a fuel has an advantage in engine performance and in particular, but not limited to, engine cleanliness, engine fuel economy, drivability and emissions.

The HADs are not consumed in unimportant areas and have increased specificity compared to conventional detergent allowing for lower levels to be used. Thus, the CCD debits, emulsifying behavior, and oil dilution propensity caused by conventional detergents can be offset through the use of lower levels of more efficacious masked detergents targeted for cleaning only specific areas of the fuel system that are important for improving engine performance.

Amines are also common functional groups in organic chemistry that often need to be protected during a multistep synthesis. In general, a protecting group is used to "protect" an otherwise labile or reactive functional group from interfering in subsequent steps of a synthesis. When this protection is no longer needed, a suitable reagent is used to "deprotect" the protected moiety. The heat activated detergents disclosed herein include a protective group that is cleaved at an elevated temperature and don't require a deprotection reagent. The protective groups that form the basis for the heat activated detergents disclosed herein may be highly hydrophobic to mask polarity of the detergent.

Provided herein are a range of heat activated detergents including a range of protective groups that meet the above performance requirements. In one form, the heat activated detergents disclosed herein include a fluorenylmethoxy carbonyl (FMOC) protection group for protecting the amino functional groups. The fluorenylmethoxy carbonyl (FMOC) protection group may also be referred to as 9-Fluorenylmethyl carbamate, FMOC amino, FMOC amine, or FMOC amide. The FMOC protection group may be introduced by coupling an amine with an activated (9H-fluoren-9-yl) methyl carbonochloridate group as illustrated in FIG. 1 where the amine if part of a PIBA fuel detergent. Its large tricyclic hydrocarbon structure provides hydrophobic masking of the polar end of the detergent. FIG. 1 shows the mono protected amine but in another form, there may be double protection by incorporation of an additional FMOC group to the mono protected primary amine.

The heat activated detergents disclosed herein may include other protection groups including, but not limited to, t-butyl carbamate (also referred to as BOC amine, BOC amino, BOC amide), riphenylmethylamine (also referred to as Tritylamine, Tr), p-Toluenesulfonamide (also referred to as Tosylamide, Ts), Benzylideneamine, Benzylamine, Benzyl carbamate (also referred to as Cbz, Z), and phthalimide. These other protection groups and their amine protection synthesis procedures are described in T. W. Green, P. G. M. Wuts, Protective Groups in Organic Synthesis, Wiley-Interscience, New York, 1999, 556-558, 740-743.

The heat activated detergents disclosed herein may include a 2,2,6,6-Tetramethylpiperidin-1-yloxycarbonyl (Tempoc) protection group with the amine protection formed by the reaction of amines with an acyl transfer reagent, 4-nitrophenyl (2,2,6,6-tetramethylpiperidin-1-yl) carbonate (NPTC). NPTC may be prepared in two steps from (2,2,6,6-Tetramethylpiperidin-1-yl)oxyl, commonly known as TEMPO, via reduction with sodium ascorbate and acylation with p-nitrophenyl chloroformate. Synthetic details may be found in the Journal Organic Letters 2018 20 (21), 6760-6764 authored by Joseph R. Lizza et al. Both primary and secondary amines are converted to the Tempoc derivatives using NPTC (1.2 equiv), amine (1 equiv), and triethylamine (3 equiv), in dimethylformamide (0.5M, room temperature, 12 hours).

The heat activated detergents disclosed herein may be included in the liquid fuel composition in any suitable amount as desired for removing intake valve deposits and/or improving injector cleanliness. In some embodiments, the HAD composition can be present in the liquid fuel composition in an effective amount with an effective amount ranging from about 0.1 parts per million ("ppm") to about 500 ppm, or 1 to 400 ppm, or 5 to 350 ppm, or 10 to 300 ppm, or 20 to 250 ppm, or 50 to 200 ppm or 75 to 150 ppm, or 100 to 125 ppm.

In some embodiments, the HAD additive may be introduced directly into a fuel system of an internal combustion engine. In some embodiments, the HAD combination may be combined with the liquid fuel composition in the internal combustion engine. In some embodiments, the HAD composition may be introduced into the internal combustion engine as a component of the liquid fuel composition. In a combustion chamber of the internal combustion engine, the liquid fuel composition may be burned. Suitable internal combustion engines may include, but are not limited to, rotary, turbine, rocket, spark ignition, compression ignition, 2-stroke, or 4-stroke engines. In some embodiments, the internal combustion engines include marine engines, aviation piston and turbine engines, aviation supersonic turbine engines, rocket engine, diesel engines, and automobile and truck engines. In some embodiments, the internal combustion engine may comprise a direct injection engine. In some embodiments, the internal combustion engine may comprise a high pressure common-rail direct fuel injection engine.

In addition to the HAD additive, the liquid fuel composition may further include a liquid fuel. The liquid fuel may include, but are not limited to, motor gasoline, aviation fuel, supersonic fuel, rocket fuel, marine fuel, and diesel fuel. Combinations of different liquid fuels may also be used. Motor gasoline includes a complex mixture of relatively volatile hydrocarbons blended to form a fuel suitable for use in spark-ignition engines. Motor gasoline, as defined in ASTM Specification D4814, is characterized as having a boiling range of 50° C. to 70° C. at the 10-percent recovery point to 185° C. to 190° C. at the 90-percent recovery point. The diesel fuel can be a petroleum distillate as defined by ASTM specification D975. The aviation fuels can be a petroleum distillate as defined by ASTM specification D1655. The supersonic fuel can be a compound mixture composed primarily of hydrocarbons; including alkanes, cycloalkanes, alkylbenzenes, indanes/tetralins, and naphthalenes. As used herein, a supersonic fuel is a fuel that meets the specification for propellant, rocket grade kerosene (either RP-1 or RP-2) in MIL-DTL-25576, dated Apr. 14, 2006. Supersonic fuels are typically capable of standing up to higher heats (without undesirable breakdown) from air friction on the aircraft at speeds greater than the speed of sound. Fuel that breaks down can potentially clog the fuel lines on its way to the burner. Additional examples of suitable liquid fuels may include, but are not limited to, an alcohol, an ether, a nitroalkane, an ester of a vegetable oil, or combinations thereof. In some embodiments, the other fuels may include, but are not limited to, methanol, ethanol, diethyl ether, methyl t-butyl ether, ethyl t-butyl ether, nitromethane, and methyl esters of vegetable oils such as the methyl ester of rapeseed oil. In some embodiments, the liquid fuel may include a mixture of a motor gasoline and ethanol or a mixture of a diesel fuel and a biodiesel fuel, such as an ester of a vegetable oil.

The motor gasoline fuel compositions of the present disclosure may be a renewable fuel such as a biofuel composition. The motor gasoline fuel compositions disclosed herein may optionally include a methanol to gasoline (MTG) or ethanol to gasoline (ETG) biofuel. The motor gasoline fuel compositions may be a liquid e-fuels like e-methanol and e-crude, also known as synthetic crude oil, which make e-kerosene and e-diesel. The e-methanol can be used in the MTG process to make renewable gasoline.

The diesel fuel compositions of the present disclosure may be a renewable fuel such as a biofuel composition or biodiesel composition. The diesel fuel compositions disclosed herein may optionally include a first generation biodiesel. First generation biodiesel contains esters of, for example, vegetable oils, animal fats and used cooking oils. This form of biodiesel may be obtained by transesterification of oils, for example rapeseed oil, soybean oil, safflower oil, palm oil, corn oil, peanut oil, cotton seed oil, tallow, coconut oil, physic nut oil (Jatropha), sunflower seed oil, and used cooking oils.

The diesel fuel compositions disclosed herein may optionally include a second generation renewable diesel. Second generation renewable diesel is derived from renewable resources such as vegetable oils and animal fats and processed, often in the refinery, often using hydroprocessing such as the H-Bio process developed by Petrobras. Second generation renewable diesel may be similar in properties and quality to petroleum based fuel oil streams, for example renewable diesel produced from vegetable oils, animal fats etc. and marketed by ConocoPhillips as Renewable Diesel and by Neste as NExBTL. These fuels are also referred to as Hydroproccessed Vegetable Oil (HVO) as they are produced by the hydrogenation of vegetable oils or animal fats.

The diesel fuel compositions disclosed herein may optionally include a third generation biodiesel. Third generation biodiesel utilizes gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel compositions disclosed herein may also contain blends of any or all of the above first, second and third generation biodiesels. The liquid fuel may be present in the liquid fuel composition with the heat activated detergent additive in any suitable amount. As previously described, the liquid fuel may include any suitable liquid fuel, including a combination of two or more different fuels. In some embodiments, the liquid fuel may be present in the liquid fuel composition in an amount ranging from 98% to 99.99% by weight of the liquid fuel composition, or from 99% to 99.9% by weight of the liquid fuel composition, or from 99.5% to 99.9% by weight of the liquid fuel composition.

In some embodiments, additional fuel additives can be included in the liquid fuel composition as desired by one of ordinary skill in the art for a particular application. Examples of these additional additives include, but are not limited to, antioxidant, high temperature antioxidants, detergents, rust inhibitors, corrosion inhibitors, friction modifiers, lubricants, antifoaming agents, demulsifiers, conductivity improvers, metal deactivators, cold-flow improvers, cetane improvers, octane improvers and fluidizers, among others.

Established standards are available to measure the propensity of intake valve deposit (IVD) formation, for example the ASTM D6201 and CEC F-05-93 engine test and ASTM D5500 vehicle test. The criteria for cleaning up valves is a reduction in deposit weight on the valves when a fuel with the additive is used.

Established standards are available to measure the propensity of fuel injector fouling from deposit formation for port fuel injection, for example the ASTM D 5598 and direct injection CEC TDG-F-113 that uses a VW EA111 CAXA (EU4) engine and GM Top Tier GDI tests that uses a 2012 GM EcoTec LHU engine. Injector fouling is measured as the percent difference of flow rate in the injector and the criteria for cleaning is a return to the designed flow rate when a fuel with the additive is used.

In another form of the instant invention, the HAD additive may be included in a lubricating oil compositions in order to improve the degraded product dispersancy in the lubricating oil.

Embodiments of the Disclosure

In one form of the instant disclosure, the heat activated fuel detergent with a polyisobutylene polymeric backbone is of the following formula:

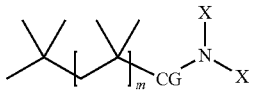

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 50.

In another form, the heat activated detergent is of the following formula:

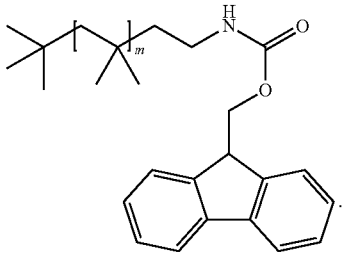

In another form of the instant disclosure, provided is a liquid fuel composition comprising: a liquid fuel and an effective amount of a heat activated detergent additive of the following formula:

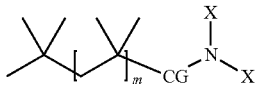

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 30.

The heat activated detergent additive of the liquid fuel composition may be of the following formula:

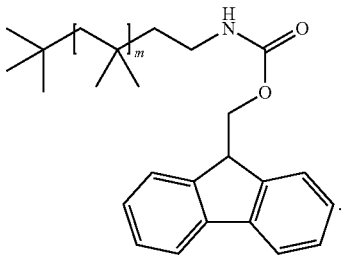

The liquid fuel of the fuel composition may be selected from the group consisting of a motor gasoline, an aviation turbine fuel, an aviation gasoline a supersonic fuel, a rocket fuel, a marine fuel, and a diesel fuel. The liquid fuel composition may also include a renewable fuel component at from 0.1 vol. % to 50 vol. %, or 5 to 45 vol. %, or 10 to 40 vol. %, 15 to 35 vol. %, or 20 to 30 vol. % of the overall liquid fuel composition. The renewable fuel component may be selected from the group consisting of hydrogenated vegetable oil, fatty acid alkyl ester, a C1-C3 alcohol and combinations thereof. One advantageous renewable component is ethanol. The renewable fuel component may be included in the fuel composition at from 0.1 vol. % to 80 vol. %, or 1 vol. % to 60 vol. %, or 3 vol. % to 50 vol. %, or 5 to 45 vol. %, or 10 to 40 vol. %, 15 to 35 vol. %, or 20 to 30 vol. % of the overall liquid fuel composition.

In a more particular form, the liquid fuel composition includes gasoline as the liquid fuel and a renewable fuel component. In the liquid fuel composition disclosed herein, the liquid fuel comprises greater than or equal to about 98 vol. %, or greater than or equal to about 98.5 vol. %, or greater than or equal to about 99 vol. %, greater than or equal to about 99.5 vol. %, or greater than or equal to about 99.9 vol. %, of the overall liquid fuel composition.

An effective amount of the heat activated detergent additive in the liquid fuel composition may range from about 0.1 ppm to about 500 ppm, or 1 to 400 ppm, or 5 to 350 ppm, or 10 to 300 ppm, or 20 to 250 ppm, or 50 to 200 ppm or 75 to 150 ppm, or 100 to 125 ppm of the overall liquid fuel composition.

The liquid fuel composition may also include at least one additional fuel additive selected from the group consisting of an antioxidant, a high temperature antioxidant, a detergent, a rust inhibitor, a corrosion inhibitor, a lubricant, an anti-foaming agent, a demulsifier, a conductivity improver, a metal deactivator, a cold-flow improver, a cetane improver, a fluidizer, and combinations thereof. The at least one additional fuel additive may be incorporated into the liquid fuel composition at from 0.1 ppm to about 1000 ppm, or 1 to 500 ppm, or 5 to 350 ppm, or 10 to 300 ppm, or 20 to 250 ppm, or 50 to 200 ppm or 75 to 150 ppm, or 100 to 125 ppm of the overall liquid fuel composition.

In another form of the instant disclosure, a heat activated fuel detergent having a hydrocarbylpoly(oxyalkylene) polymeric backbone is of the following formula:

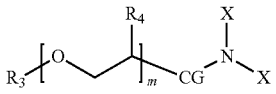

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 50, wherein $R_3$ is a hydrocarbyl group including from 1 to 30 carbon atoms, and wherein $R_4$ is a hydrocarbyl group including from 1 to 6 carbon atoms.

In another form of the instant disclosure, provided is a liquid fuel composition comprising: a liquid fuel and an effective amount of a heat activated detergent additive of the following formula:

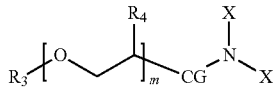

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 50, wherein R3 is a hydrocarbyl group including from 1 to 30 carbon atoms, and wherein R4 is a hydrocarbyl group including from 1 to 6 carbon atoms.

The liquid fuel of the fuel composition may be selected from the group consisting of a motor gasoline, an aviation turbine fuel, an aviation gasoline a supersonic fuel, a rocket fuel, a marine fuel, and a diesel fuel. The liquid fuel composition may also include a renewable fuel component at from 0.1 vol. % to 50 vol. %, or 5 to 45 vol. %, or 10 to 40 vol. %, 15 to 35 vol. %, or 20 to 30 vol. % of the overall liquid fuel composition. The renewable fuel component may be selected from the group consisting of hydrogenated vegetable oil, fatty acid alkyl ester, a C1-C3 alcohol and combinations thereof. One advantageous renewable component is ethanol. The renewable fuel component may be included in the fuel composition at from 0.1 vol. % to 50 vol. %, or 5 to 45 vol. %, or 10 to 40 vol. %, 15 to 35 vol. %, or 20 to 30 vol. % of the overall liquid fuel composition.

In a more particular form, the liquid fuel composition includes gasoline as the liquid fuel and a renewable fuel component. In the liquid fuel composition disclosed herein, the liquid fuel comprises greater than or equal to about 98 vol. %, or greater than or equal to about 98.5 vol. %, or greater than or equal to about 99 vol. %, greater than or equal to about 99.5 vol. %, or greater than or equal to about 99.9 vol. %, of the overall liquid fuel composition.

An effective amount of the heat activated detergent additive in the liquid fuel composition may range from about 0.1 ppm to about 500 ppm, or 1 to 400 ppm, or 5 to 350 ppm, or 10 to 300 ppm, or 20 to 250 ppm, or 50 to 200 ppm or 75 to 150 ppm, or 100 to 125 ppm of the overall liquid fuel composition.

The liquid fuel composition may also include at least one additional fuel additive selected from the group consisting of an antioxidant, a high temperature antioxidant, a detergent, a rust inhibitor, a corrosion inhibitor, a lubricant, an anti-foaming agent, a demulsifier, a conductivity improver, a metal deactivator, a cold-flow improver, a cetane improver, a fluidizer, and combinations thereof. The at least one additional fuel additive may be incorporated into the liquid fuel composition at from 0.1 ppm to about 1000 ppm, or 1 to 500 ppm, or 5 to 350 ppm, or 10 to 300 ppm, or 20 to 250 ppm, or 50 to 200 ppm or 75 to 150 ppm, or 100 to 125 ppm of the overall liquid fuel composition.

Also disclosed herein are methods improving intake valve and injector cleanliness of an engine for a vehicle utilizing a liquid fuel composition. In one form, the method for improving intake valve and injector cleanliness of an engine for a vehicle utilizes a liquid fuel composition comprising the following: providing to the vehicle a liquid fuel composition comprising a liquid fuel including an effective amount of a heat activated detergent additive of the following formula:

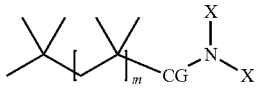

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 30, injecting the liquid fuel composition into the engine and combusting the liquid fuel composition, and measuring the amount of deposits on the engine valves and the engine injectors, wherein the amount of deposit build-up on the engine valves and injectors are decreased by about 10% to about 100%%, or 20% to 90%, or 30% to 80%, or 40% to 60% compared to a comparable liquid fuel not including the heat activated detergent additive.

In another form, the method for improving intake valve and injector cleanliness of an engine for a vehicle utilizes a liquid fuel composition comprising the following: providing to the vehicle a liquid fuel composition comprising a liquid fuel including an effective amount of a heat activated detergent additive of the following formula:

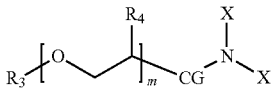

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 30, wherein R3 is a hydrocarbyl group including from 1 to 30 carbon atoms, and wherein R4 is a hydrocarbyl group including from 1 to 6 carbon atoms, injecting the liquid fuel composition into the engine and combusting the liquid fuel composition, and measuring the amount of deposits on the engine valves and the engine injectors, wherein the amount of deposit build-up on the engine valves and injectors are decreased by 10% to 100%, or 20% to 90%, or 30% to 80%, or 40% to 60% compared to a comparable liquid fuel not including the heat activated detergent additive.

To facilitate a better understanding of the present disclosure, the following examples of certain aspects of some embodiments are given. In no way should the following examples be read to limit, or define, the entire scope of the disclosure.

Examples

Test Methods

Figure 2:
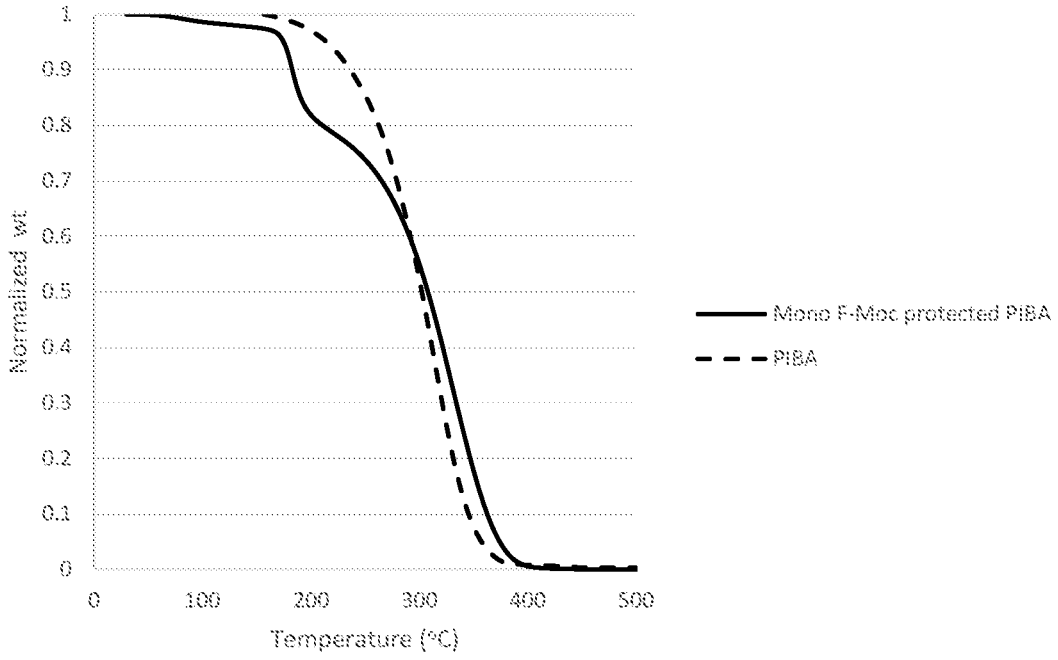
FIG. 2 depicts a TGA thermogram of PIBA and mono-protected FMOC PIBA.

Thermogravimetric analysis (TGA) may be used as an analytical technique to determine the temperature at which the protective groups cleaves from the amine. FIG. 2 shows the TGA thermogram of PIBA and mono-protected FMOC PIBA and revealed that the FMOC protective group cleaved at 185° C. This temperature corresponds to a sharp loss of 18% of the sample weight associated with the cleavage and volatilization of the FMOC protecting group. The shoulder, or plateau area of the curve, represents the mass of the stable deprotected amine polymer which decomposes similar to an unprotected PIBA.

Figure 3:
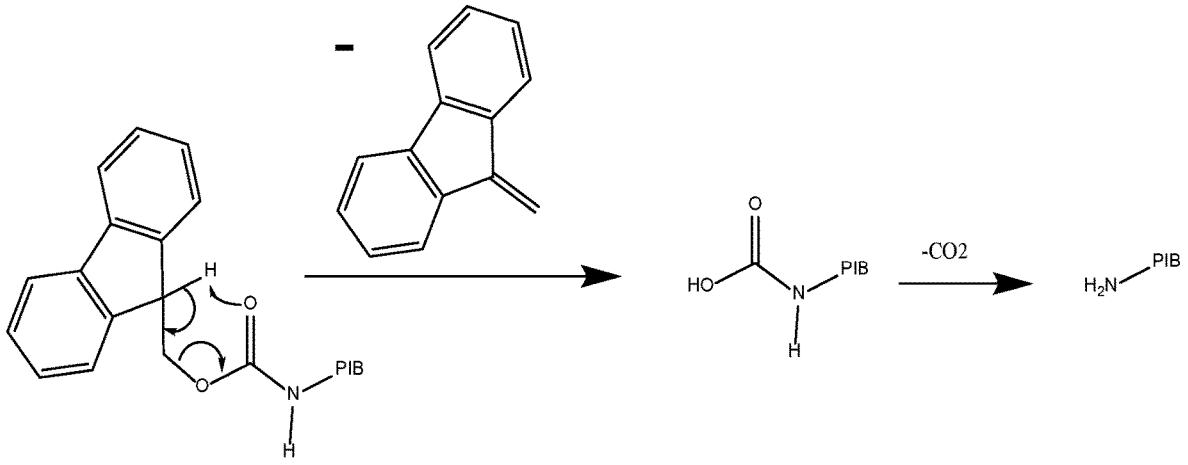
FIG. 3 depicts the possible thermal degradation pathway for FMOC protected PIBA.

It can be determined from these weight loss profiles that the thermally unprotected polymer is stable and exists over a 100° range, indicating that these materials are excellent candidates for a single thermal deprotection step. Possible deprotection mechanism is through an en-type decomposition (pyrolysis) as shown in FIG. 3.

Figure 4:
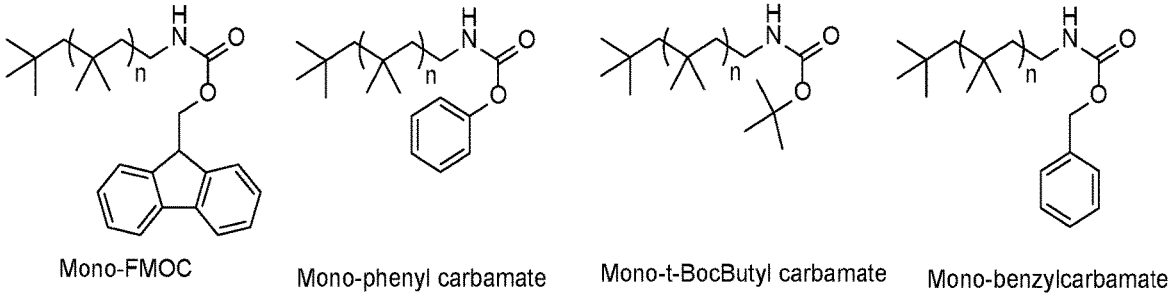
FIG. 4 depicts PIBA with various single amine protective groups.

A water reaction tests (D1094) was used to demonstrate the suppression of the "always active" detergent like character by masking the amine head group of the detergent with a non-polar protective group. In these tests the fuel was mixed with water and shaken. The interface between the two liquids was monitored for a period of time for emulsion behavior. Fuels typically separate from the water when there are no surfactant like molecules present in the fuel. The following Table 1 shows the comparative water tolerance properties of fuels without detergent, fuels with prior art detergent and fuels including the heat activated detergents disclosed herein. The fuel without detergent had very little emulsion behavior. Fuels with PIBA, which is a surfactant, exhibited severe emulsions that persisted for 24 hrs in PH 4 buffer. When the same detergents were protected with various non polar protective groups highlighted in FIG. 4, the emulsion did not persist for more than 1 hr in pH 4 buffer. Masked-PIBA behaved in pH 10 buffer similar to fuel without additive demonstrating the masking of the surfactant character of the conventional detergent.

TABLE 1

| ASTM D1094 aqueous change | | | | | | | | |
|---|---|---|---|---|---|---|---|---|
| | | | | | ULSD with mono protected PIBA | | | |
| | | | ULSD with PIBA | | FMOC | phenyl carbamate | t-butyl carbamate | benzyl-carbamate |
| Buffer | Time | ULSD | 50 ppm | 100 ppm | 80 ppm | 75 ppm | 73 ppm | 76 ppm |
| pH 4 | 5 min | −10 | −19 | −17 | −11.5 | −6 | −6 | −4 |
| | 1 HR | 0 | −15 | −12 | 0 | −1 | −0.5 | 0.5 |
| | 24 HR | 0 | −11 | −6 | 0 | 0 | 0 | 0.5 |
| pH 10 | 5 min | 0 | −11 | −19 | 0 | | | |
| | 1 HR | 0 | 0.5 | −5 | 0.5 | | | |
| | 24 HR | 0 | 0.5 | −2.5 | 0.5 | | | |

While the invention has been described with respect to a number of embodiments and examples, those skilled in the art, having benefit of this disclosure, will appreciate that other embodiments can be devised which do not depart from the scope and spirit of the invention as disclosed herein. Although individual embodiments are discussed, the invention covers all combinations of all those embodiments.

While compositions, methods, and processes are described herein in terms of "comprising," "containing," "having," or "including" various components or steps, the compositions and methods can also "consist essentially of" or "consist of" the various components and steps. The phrases, unless otherwise specified, "consists essentially of" and "consisting essentially of" do not exclude the presence of other steps, elements, or materials, whether or not, specifically mentioned in this specification, so long as such steps, elements, or materials, do not affect the basic and novel characteristics of the invention, additionally, they do not exclude impurities and variances normally associated with the elements and materials used.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited.

What is claimed is:

1. A heat activated fuel detergent with a polyisobutylene polymeric backbone, wherein the detergent is of the following formula:

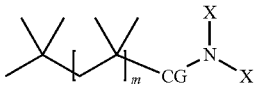

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 50.

2. The detergent of claim 1 having, the following formula:

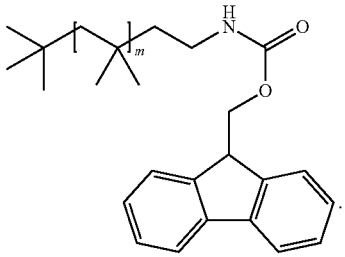

3. The detergent of claim 1, wherein the detergent is incorporated into a liquid fuel composition.

4. A liquid fuel composition comprising: a liquid fuel and an effective amount of a heat activated detergent additive of the following formula:

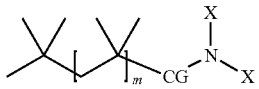

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 30.

5. The liquid fuel composition of claim 4, wherein the detergent one of the is of the following formula:

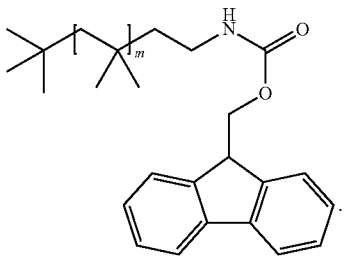

6. The liquid fuel composition of claim 4, wherein the liquid fuel is selected from the group consisting of a motor gasoline, an aviation turbine fuel, an aviation gasoline, a supersonic fuel, a rocket fuel, a marine fuel, and a diesel fuel.

7. The liquid fuel composition of claim 4 further comprising a renewable fuel component.

8. The liquid fuel composition of claim 7, wherein the renewable fuel component is selected from the group consisting of hydrogenated vegetable oil, fatty acid alkyl ester, a C1-C3 alcohol MTG, ETG, and combinations thereof.

9. The liquid fuel composition of claim 8, wherein the renewable fuel component is ethanol.

10. The liquid fuel composition of claim 8, wherein the renewable fuel component comprises from 0.1 vol % to 80 vol % of the overall liquid fuel composition.

11. The liquid fuel composition of claim 4, wherein the liquid fuel comprises a mixture of gasoline and a renewable fuel component.

12. The liquid fuel composition of claim 4, wherein the liquid fuel comprises greater than or equal to 98 vol % of the overall liquid fuel composition.

13. The liquid fuel composition of claim 4, wherein the effective amount of the heat activated detergent additive ranges from 0.1 ppm to 500 ppm of the overall liquid fuel composition.

14. The liquid fuel composition of claim 4, wherein the liquid fuel comprises 99 vol. % or greater of the overall liquid fuel composition, and wherein the effective amount of the heat activated detergent additive ranges from 1 ppm to 500 ppm of the overall liquid fuel composition.

15. The liquid fuel composition of claim 4, further comprising at least one additional fuel additive selected from the group consisting of an antioxidant, a high temperature antioxidant, a detergent, a rust inhibitor, a corrosion inhibitor, a lubricant, an antifoaming agent, a demulsifier, a conductivity improver, a metal deactivator, a cold-flow improver, a cetane improver, a fluidizer, and combinations thereof.

16. A method for improving intake valve and injector cleanliness of an engine for a vehicle utilizing a liquid fuel composition comprising the following:

providing to the vehicle a liquid fuel composition comprising a liquid fuel including an effective amount of a heat activated detergent additive of the following formula.

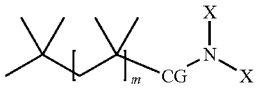

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl, and combinations thereof, wherein CG is a connecting group selected from the group consisting of a dialkyl group, a carbamate group, an aromatic group, a phenolic group, and a polyethylamine group, and wherein m is an integer ranging from 5 to 30, injecting the liquid fuel composition into the engine and combusting the liquid fuel composition, and measuring the amount of deposits on the engine valves and the engine injectors, wherein the amount of deposit build-up on the engine intake valves (intake valve deposits) are decreased by 10% to 100% compared to a comparable liquid fuel not including the heat activated detergent additive.

17. A heat activated fuel detergent comprising a hydrocarbylpoly(oxyalkylene) polymeric backbone of the following formula:

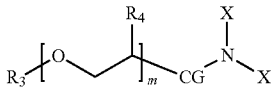

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 50, wherein $R_3$ is a hydrocarbyl group including from 1 to 30 carbon atoms, and wherein $R_4$ is a hydrocarbyl group including from 1 to 6 carbon atoms.

18. A liquid fuel composition comprising: a liquid fuel and an effective amount of a heat activated detergent additive of the following formula:

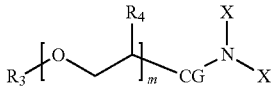

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 50, wherein $R_3$ is a hydrocarbyl group including from 1 to 30 carbon atoms, and wherein $R_4$ is a hydrocarbyl group including from 1 to 6 carbon atoms.

19. The liquid fuel composition of claim 18 further comprising a renewable fuel component.

20. The liquid fuel composition of claim 19, wherein the renewable fuel component is selected from the group consisting of hydrogenated vegetable oil, fatty acid alkyl ester, a C1-C3 alcohol, MTG, ETG, and combinations thereof.

21. The liquid fuel composition of claim 19, wherein the renewable fuel component is ethanol.

22. The liquid fuel composition of claim 19, wherein the renewable fuel component comprises from 0.1 vol. % to 80 vol. % of the overall liquid fuel composition.

23. The liquid fuel composition of claim 18, wherein the effective amount of the heat activated detergent additive ranges from 0.1 ppm to 500 ppm of the overall liquid fuel composition.

24. The liquid fuel composition of claim 18, wherein the liquid fuel comprises 99 vol. % or greater of the overall liquid fuel composition, and wherein the effective amount of the heat activated detergent additive ranges from 1 ppm to 500 ppm of the overall liquid fuel composition.

25. The liquid fuel composition of claim 18, further comprising at least one additional fuel additive selected from the group consisting of an antioxidant, a high temperature antioxidant, a detergent, a rust inhibitor, a corrosion inhibitor, a lubricant, an antifoaming agent, a demulsifier, a conductivity improver, a metal deactivator, a cold-flow improver, a cetane improver, a fluidizer, and combinations thereof.

26. A method for improving intake valve and injector cleanliness of an engine for a vehicle utilizing a liquid fuel composition comprising the following:

providing to the vehicle a liquid fuel composition comprising a liquid fuel including an effective amount of a heat activated detergent additive of the following formula:

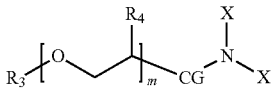

wherein X is hydrogen or a masking group (MG) with at least one X being MG, wherein MG is selected from the group consisting of fluorenylmethoxy carbonyl, phenyl carbamate, t-butyl carbamate, benzyl-carbamate, 2,2,6,6-tetramethylpiperidin-1-yloxycarbonyl group type, and combinations thereof, wherein CG is a connecting group selected from the group consisting of a dialkyl group, a carbamate group, an aromatic group, a phenolic group, and a polyethylamine group type, and wherein m is an integer ranging from 5 to 30, wherein $R_3$ is a hydrocarbyl group including from 1 to 30 carbon atoms, and wherein $R_4$ is a hydrocarbyl group including from 1 to 6 carbon atoms injecting the liquid fuel composition into the engine and combusting the liquid fuel composition, and measuring the amount of deposits on the engine valves and the engine injectors, wherein the amount of deposit build-up on the engine intake valves (intake valve deposits) are decreased by 10% to 100% compared to a comparable liquid fuel not including the heat activated detergent additive.

* * * * *